US006010358A

United States Patent [19]

Ii

[11] Patent Number: 6,010,358

[45] Date of Patent: Jan. 4, 2000

[54] ELECTRICAL CONNECTOR FOR FLAT FLEXIBLE CIRCUITRY

[75] Inventor: Hidehiro Ii, Koube, Japan

[73] Assignee: Molex Incorporated, Lisle, Ill.

[21] Appl. No.: 09/102,225

[22] Filed: Jun. 22, 1998

[30] Foreign Application Priority Data

Jul. 4, 1997 [JP] Japan ..... 9-195092

[51] Int. Cl.[7] ..... H01R 9/07

[52] U.S. Cl. ..... 439/496

[58] Field of Search ..... 439/496, 456

[56] References Cited

U.S. PATENT DOCUMENTS 3,897,130 7/1975 Donnelly ..... 439/496

4,784,615 11/1988 Teng-Hong ..... 439/496

*Primary Examiner*—Neil Abrams
*Assistant Examiner*—Javad Nasri
*Attorney, Agent, or Firm*—Stephen Z. Weiss

[57] ABSTRACT

A male connector (1) is provided for electrically interconnecting the conductors (6) of a flat flexible circuit (4) to the conductors (24) of a complementary mating connecting device (2). The connector includes a male body member (10) about which the flexible circuit (4) is wrapped. Locating projections (13) are provided at one side (10*a*) of the body member (10) for engaging and holding a distal end (7) of the flexible circuit. A strain relief structure (19,20) is provided at the opposite side (10*b*) of the body member defining a tortuous path through which the flexible circuit (4) is passed to lock the circuit on the connector.

2 Claims, 5 Drawing Sheets

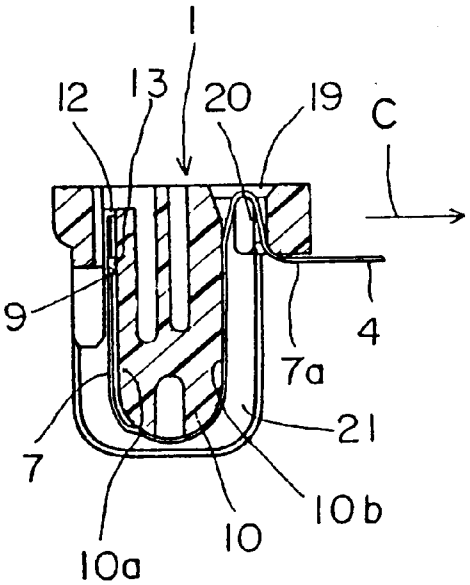
FIG.10D
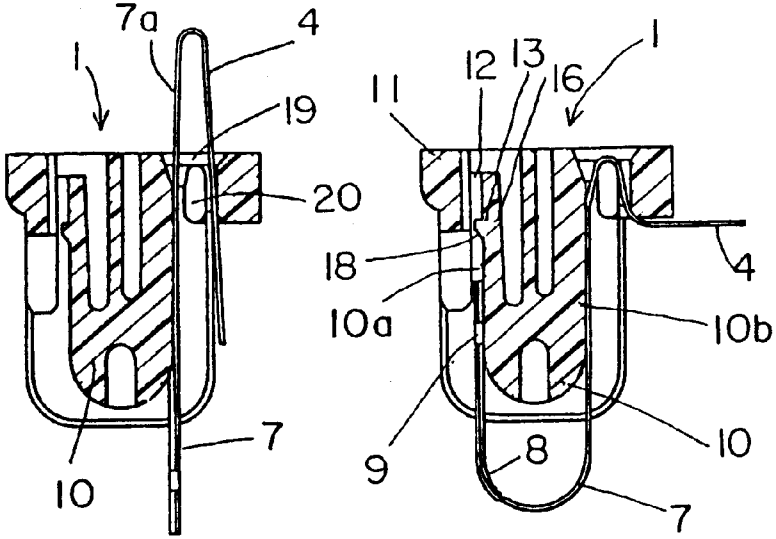
FIG.10C
FIG.10B
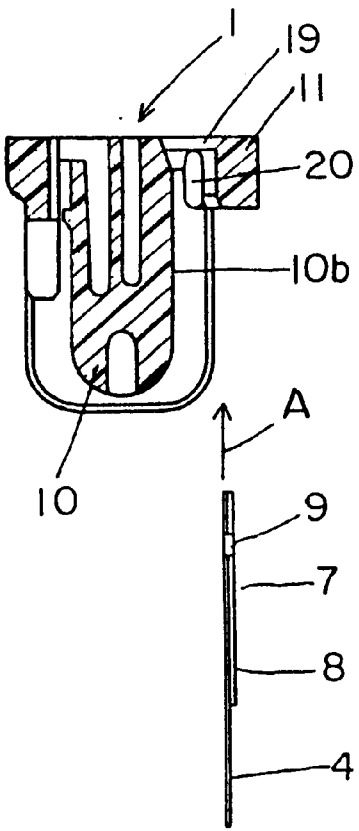
FIG.10A

ELECTRICAL CONNECTOR FOR FLAT FLEXIBLE CIRCUITRY

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

A wide variety of connectors have been designed over the years for terminating or interconnecting flat flexible circuits with complementary mating connecting devices. Major problems continue to plague such connectors, particularly in the area of cost and reliability. In particular, a male connector for a flat flexible circuit typically includes a male body member about which the flexible circuit is wrapped. The male connector is mated with a female connector, with the male body member inserted into a receptacle of the female connector. For instance, the receptacle may include a plurality of terminals for engaging the conductors of the flat flexible circuit. There continuously are problems in holding the flat flexible circuit about the male body member during mating. Any lateral deviation of the flexible circuit from its intended position will cause misalignment between the conductors of the flat circuit and the terminals of the female connector, resulting in improper or inadequate connections.

The present invention is directed to solving these problems.

SUMMARY OF THE INVENTION

An object, therefore, of the invention is to provide a new and improved male connector for electrically interconnecting the conductors of a flat flexible circuit to the conductors of a complementary mating connecting device.

In the exemplary embodiment of the invention, the connector includes a male body member about which the flexible circuit is wrapped. Locating means are provided at one side of the body member for engaging and holding a distal end of the flexible circuit. Strain relief means are provided at the opposite side of the body member to lock the circuit on the connector.

As disclosed herein, the locating means include at least one projection on the one side of the body member engageable in an aperture in the flexible circuit. The projection is located in a first slot adjacent the one side of the body member. The strain relief means defines a tortuous path through which the flexible circuit is passed. The strain relief means is located in a second slot adjacent the opposite side of the body member. The strain relief means is formed by a finger about which the flexible circuit is wrapped in its tortuous path.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which:

FIGS. 10A–10D are sequential views showing the manner of securing the flat flexible circuit to the male connector.

DETAILED DESCRIPTION OF THE PREFERRED EMBODIMENT

Figure 1:
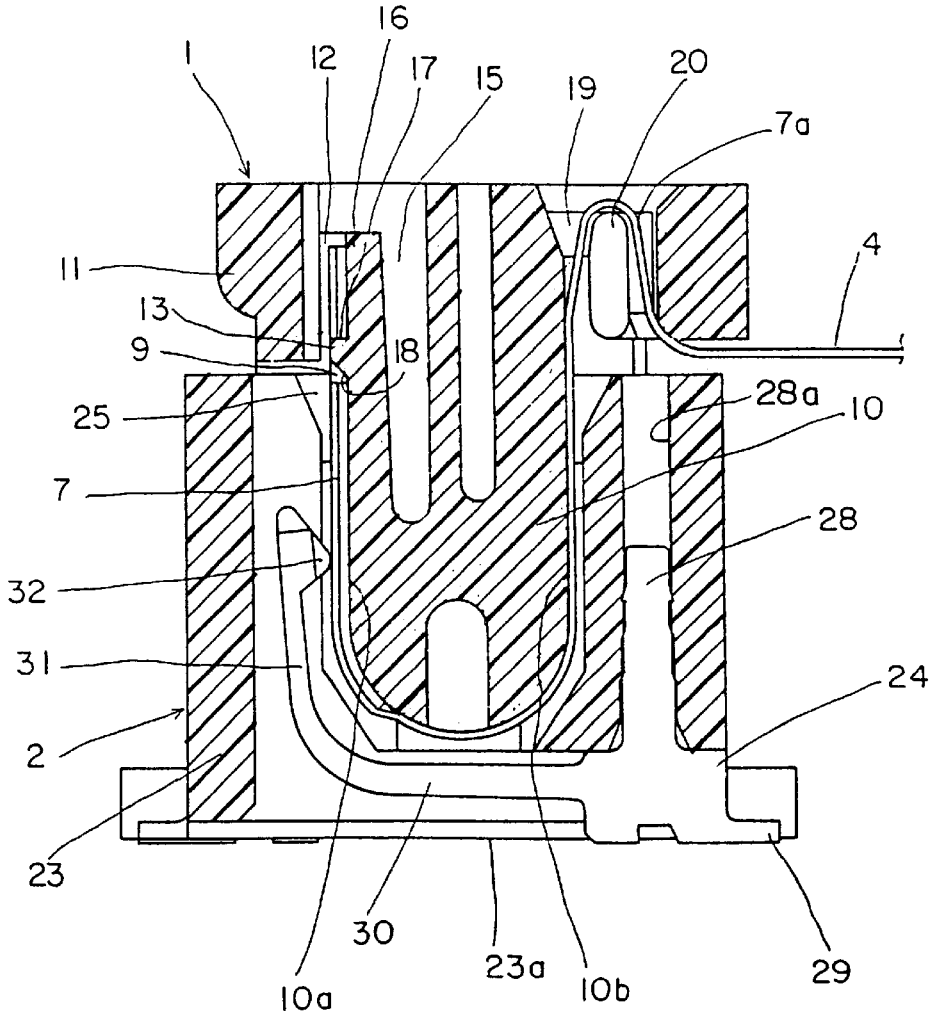
FIG. 1 is an enlarged transverse section through a connector assembly for a flat flexible circuit, according to the present invention.
Figure 4:
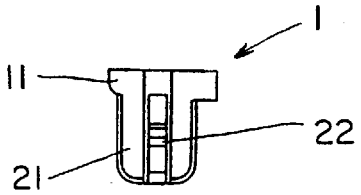
FIG. 4 is an end elevational view of the male connector.
Figure 5:
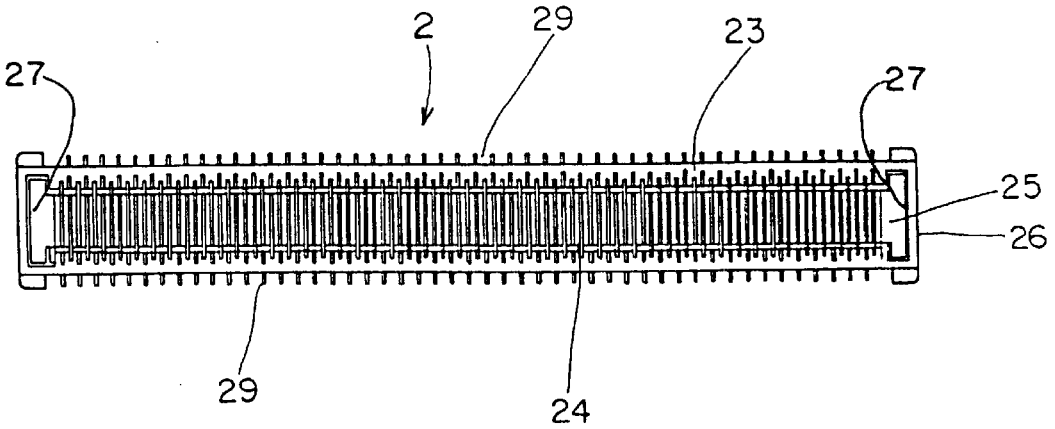
FIG. 5 is a plan view of the receptacle connector of the assembly.
Figure 6:
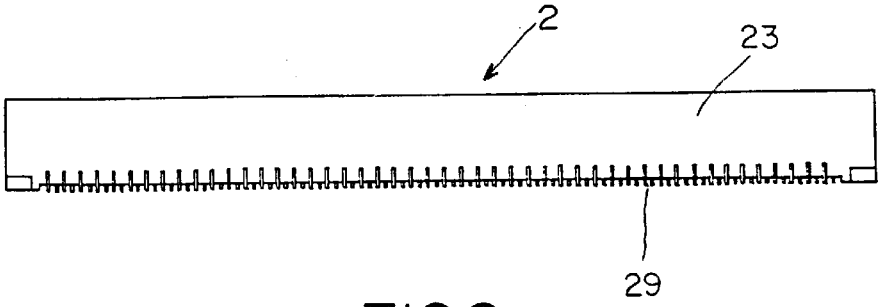
FIG. 6 is a side elevational view of the receptacle connector.
Figure 7:
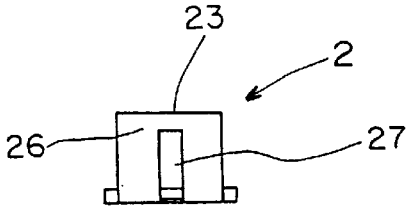
FIG. 7 is an end elevational view of the receptacle connector.
Figure 8:
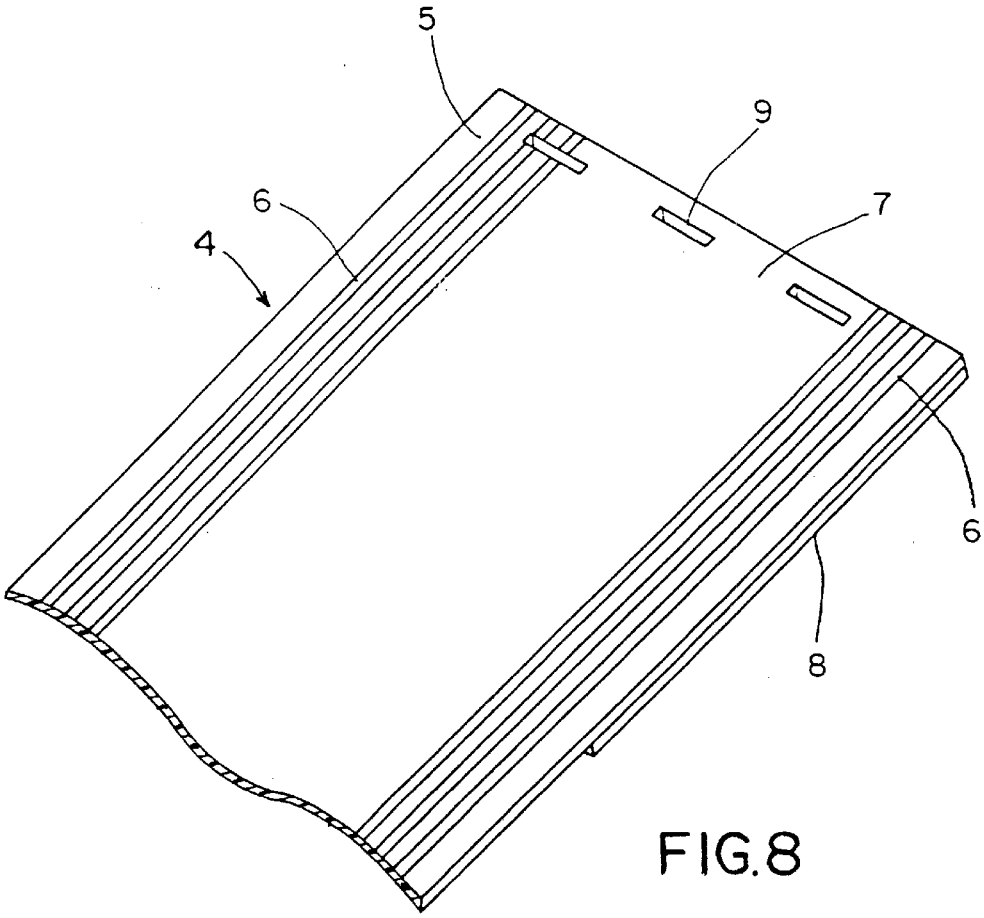
FIG. 8 is a plan view of the connecting end of the flat flexible circuit which is to be wrapped about the male connector.

Referring to the drawings in greater detail, and first to FIG. 1, the invention is embodied in an electrical connector assembly which includes a male connector, generally designated 1 (FIGS. 2–4), and a receptacle connector, generally designated 2 (FIGS. 5–7). FIG. 8 shows a flat flexible circuit, generally designated 4, fabricated of an elongated flexible substrate 5 having a plurality of conductors 6 in a parallel arrangement at regular lateral intervals. The conductors are fixed to one side of the substrate. A flexible reinforcing plate 8 is adhered to a connecting end 7 of substrate 5. A plurality of engagement apertures 9 are formed in the substrate and the reinforcement plate generally transversely of connecting end 7 of the flat flexible circuit.

Figure 2:
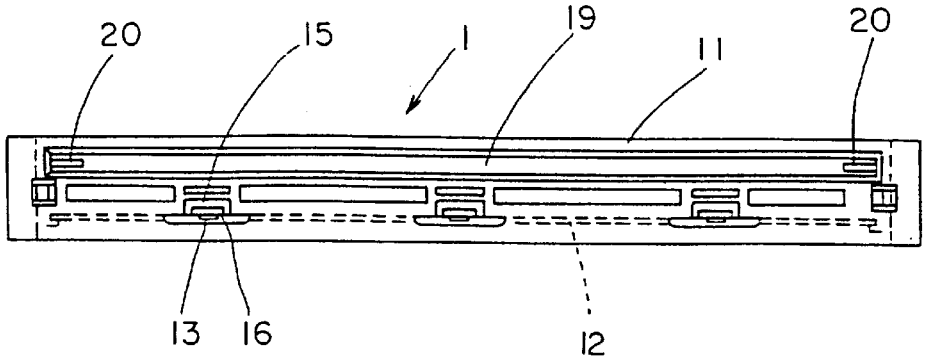
FIG. 2 is a plan view of the male connector of the assembly.
Figure 3:
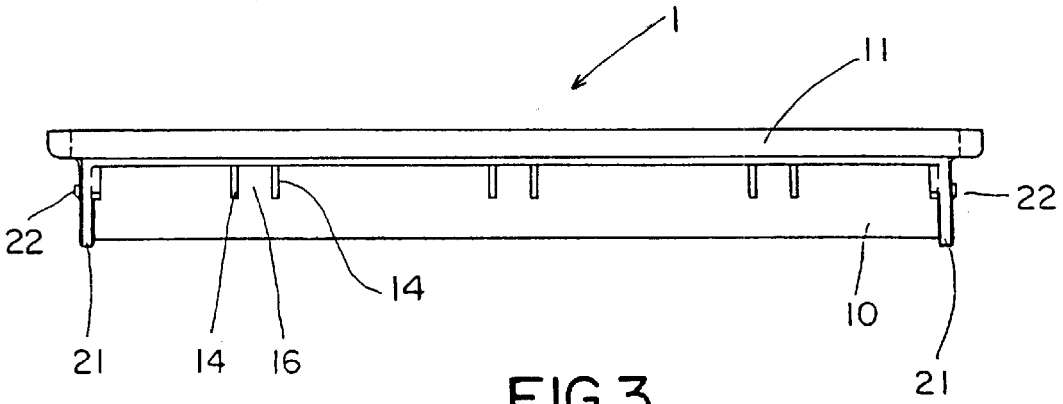
FIG. 3 is a side elevational view of the male connector.

Referring to FIGS. 2–4 in conjunction with FIG. 1, male connector 1 is structured for holding and locking flat flexible circuit 4 at its connecting end 7. The male connector is a one-piece structure unitarily molded of dielectric material such as plastic or the like. The male connector includes a male body member 10 which projects from an enlarged collar 11. A first slot 12 is formed between collar 11 and one side 10*a* of male body member 10 at the root thereof. The first slot is somewhat wider than the thickness of connecting end 7 of the flat flexible circuit, including reinforcement plate 8, to permit insertion of the connecting end of the circuit into the slot. As seen best in FIG. 1, a plurality of engagement projections 13 protrude outwardly of side 10*a* of male body member 10 within first slot 12. The projections are sized and spaced for interengagement within apertures 9 at the connecting end of flat flexible circuit 4.

Referring to FIGS. 2 and 3, male body member 10 has two slits 14 and a recess 15 (see also FIG. 1) which combine to form a resilient tongue 16 on which each engagement projection 13 is formed. As seen in FIG. 1, each projection has an abrupt side defining a locking shoulder 17 and an angled or oblique side 18.

A second slot 19 is formed between collar 11 and the root of male body member 10 on the opposite side 10*b* thereof for passing flat flexible circuit 4 therethrough. A pair of fingers 20 (FIG. 2) project inwardly from opposite ends of slot 19. With this slot and finger arrangement, an undulated or tortuous path is defined as best shown in FIG. 1 for passing flat flexible circuit 4 therethrough. This tortuous path creates a locking means to lock the circuit to the connector. Finally, a pair of flanges 21 are molded integrally with male body member 10 at opposite ends thereof (see FIG. 3) to prevent lateral shifting of the elongated flat flexible circuit. Each flange 21 has a latch boss 22 projecting outwardly therefrom.

Referring to FIGS. 5–7 and 9 in conjunction with FIG. 1, receptacle connector 2 includes a housing 23 molded of dielectric material such as plastic. The housing mounts a plurality of terminals, generally designated 24, spaced longitudinally of the housing corresponding to the lateral spacing of conductors 6 on flat flexible circuit 4. Dielectric housing 23 has a mating receptacle 25 for receiving male body member 10 of male connector 1. The housing has end walls 26 provided with openings 27 for engagement with latch bosses 22 on the outsides of flanges 21 of the male connector.

Figure 9:
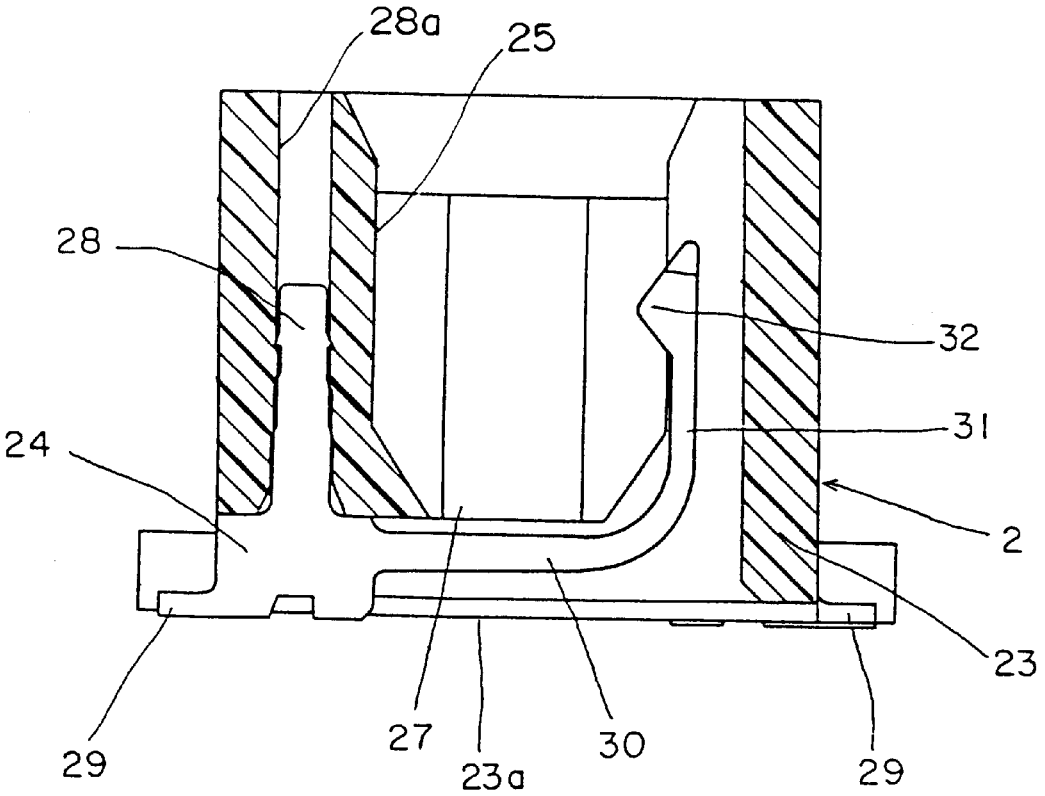
FIG. 9 is a cross section through the receptacle connector.

As seen best in FIGS. 1 and 9, each terminal 24 includes a horizontal base 30 extending generally parallel to a bottom surface-mounting face of dielectric housing 23. A locking leg 28 projects upwardly from base 30 for locking within a hole 28*a* in housing 23. A resilient contact arm 31 projects upwardly from base 30 and includes a contact portion 32 projecting into receptacle 25 for engagement with one of the conductors of the flat flexible circuit. Tails 29 of the terminals project from the bottom of housing 23 generally at the board-mounting face 23*a* thereof for connection, as by soldering, to appropriate circuit traces on a printed circuit board.

Terminals 24 alternate in opposite orientations longitudinally of the connector as can be understood by comparing FIGS. 1 and 9. Therefore, contact arms 31 (and contact points 32) alternate longitudinally of the connector to confront one or the other sides 10*a* or 10*b* of male body member 10 when inserted into receptacle 25 of housing 23. FIG. 5 shows the terminals alternating longitudinally of the connector.

FIGS. 10A–10D show sequential views in assembling flat flexible circuit 4 to male connector 10 so that the flat flexible circuit is wrapped around and securely locked about male body member 10 of the connector. In particular, FIG. 10A shows connecting end 7 of flat flexible circuit 4 being inserted in the direction of arrow "A" toward the male connector. The connecting end is to be inserted into second slot 19 on the outside of fingers 20 which are located at opposite ends of the slot. The connecting end then is reversed, as at 40, and passed back through slot 19 in the direction of arrow "B" through the slot on the inside of fingers 20. The flat flexible circuit then is bent around male body member 10 and is aligned with first slot 12 as shown in FIG. 10*c*. The connecting end is inserted further into slot 12 as shown in FIG. 10D until engagement apertures 9 at the connecting end of the circuit lock into projections 13. More specifically, as better seen in FIG. 1, engagement apertures 9 lock behind abrupt shoulders 17 of projections 13. Any slack in the flat flexible circuit can be taken out by manipulating the circuit until it is snugly wrapped about male body member 10 and about fingers 20 within slot 19.

When flat flexible circuit 4 is fully assembled to male connector 10 as shown in FIGS. 1 and 10D, the connecting end of the circuit is located and held by projections 13 on side 10*a* of male body member 10. With the circuit wrapped about fingers 20 within slot 19 on side 10*b* of the male body member, the circuit is located in a tortuous path which locks the circuit on the connector against forces pulling on the circuit in the direction of arrow "C" (FIG. 10D).

Referring back to FIG. 1, when male body member 10 of male connector 1 is inserted into receptacle 25 of receptacle connector 2, contact points 32 of resilient contact arms 31 come into contact with conductors 6 of flat flexible circuit 4, thereby making a desired connection between the flat flexible circuit and selected circuit traces on a printed circuit board on which receptacle connector 2 is mounted. The male connector is retained in the receptacle connector by latch bosses 22 on the outsides of flanges 21 interengaging in openings 27 in opposite ends of dielectric housing 23 of the receptacle connector. The flat flexible circuit is positively locked on male body member 10 to maintain the conductors thereon in precise alignment for engaging contact points 32 of terminals 24, thus assuring a reliable electrical connection between the two connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A male connector for electrically interconnecting the conductors of a flat flexible circuit to the conductors of a complementary mating connecting device, comprising:

a male body member about which the flexible circuit is wrapped;

locating means at one side of the body member for engaging and holding a distal end of the flexible circuit including at least one projection on said one side of the body member engageable in an aperture in the flexible circuit; and strain relief means at the opposite side of the body member consisting of a slot adjacent said opposite side of the body member and a pair of fingers projecting inwardly from opposite sides of the second slot about which the flexible circuit is wrapped defining a tortuous path through which the flexible circuit is passed to lock the circuit on the connector.

2. The male connector of claim 1 wherein said projection is located in a second slot adjacent said one side of the body member.

* * * * *